US007648307B2

(12) United States Patent
Gondou et al.

(10) Patent No.: US 7,648,307 B2
(45) Date of Patent: Jan. 19, 2010

(54) UNDERGROUND STRUCTURE COVER

(75) Inventors: Yukinori Gondou, Fukuoka (JP); Tomokazu Hasegawa, Fukuoka (JP); Masakazu Hidaka, Fukuoka (JP); Norio Shinohara, Fukuoka (JP); Kenichi Koga, Fukuoka (JP); Kazumi Tanaka, Fukuoka (JP)

(73) Assignee: Hinode Inc., Fukuoka-shi (JP)

( * ) Notice: Subject to any disclaimer, the term of this patent is extended or adjusted under 35 U.S.C. 154(b) by 662 days.

(21) Appl. No.: 10/556,130

(22) PCT Filed: May 12, 2004

(86) PCT No.: PCT/JP2004/006388

§ 371 (c)(1),
(2), (4) Date: Nov. 9, 2005

(87) PCT Pub. No.: WO2004/101900

PCT Pub. Date: Nov. 25, 2004

(65) Prior Publication Data

US 2007/0062125 A1 Mar. 22, 2007

(30) Foreign Application Priority Data

May 13, 2003 (JP) ..... 2003-134928

(51) Int. Cl.
*E02D 29/14* (2006.01)

(52) U.S. Cl. ..... 404/26; 404/25

(58) Field of Classification Search ..... 404/25, 404/26; 49/40; 52/19, 20; 137/364
See application file for complete search history.

(56) References Cited

U.S. PATENT DOCUMENTS 1,600,761 A * 9/1926 Haase ..... 220/284
2,109,287 A * 2/1938 Elkington ..... 404/25
2,363,567 A * 11/1944 Blakeman ..... 292/6

(Continued)

FOREIGN PATENT DOCUMENTS

DE 200 04 987 U1 5/2000

(Continued)

OTHER PUBLICATIONS

Supplementary European Search Report dated Feb. 6, 2008 issued in a counterpart European Application.

(Continued)

*Primary Examiner*—Gary S Hartmann
(74) *Attorney, Agent, or Firm*—Frishauf, Holtz, Goodman & Chick, P.C.

(57) ABSTRACT

An underground structure cover comprises a cover body (10) and a receiving frame (20) arranged so that the cover body is fitted in and supported by the receiving frame in the manner that an inclined surface (11) of the outer circumference of the body meets an inclined surface (21) of the inner circumference of the frame. The inclined surfaces (11, 21) each have an upper inclined surface (11*a*, 21*a*) and a lower inclined surface (11*b*, 21*b*), and the lower inclined surfaces (11*b*, 21*b*) are steeper than the upper inclined surfaces (11*a*, 21*a*). The body (10) is fitted in and supported by the part (20) at the upper inclined surfaces (11*a*, 21*a*) and the lower inclined surfaces (11*b*, 21*b*). By this, the body is prevented from being wedged into the frame too deeply and also from becoming inclined with respect to the frame or riding up.

4 Claims, 4 Drawing Sheets

U.S. PATENT DOCUMENTS

| | | | | |
|---|---|---|---|---|
| 3,561,470 | A * | 2/1971 | Hawle | 137/371 |
| 4,772,154 | A * | 9/1988 | Caroulle | 404/25 |
| 5,056,955 | A * | 10/1991 | Spiess et al. | 404/25 |
| 6,953,301 | B2 * | 10/2005 | Koga et al. | 404/25 |

FOREIGN PATENT DOCUMENTS

| | | | |
|---|---|---|---|
| GB | 902650 | | 8/1962 |
| JP | 53-72357 | | 6/1978 |
| JP | 57-202449 | U | 12/1982 |
| JP | 60-19162 | Y2 | 6/1985 |
| JP | 2003-239311 | A | 8/2003 |

OTHER PUBLICATIONS

Japanese Office Action dated Jul. 28, 2008 and partial English translation thereof issued in counterpart Japanese Appln. No. 2005-506180.

* cited by examiner

UNDERGROUND STRUCTURE COVER

This application is a U.S. National Phase Application under 35 USC 371 of International Application PCT/JP2004/006388 filed May 12, 2004.

TECHNICAL FIELD

This invention relates to an underground structure cover comprising a cover body and a receiving frame, particularly a support structure in which the cover body is supported by the receiving frame.

It is to be noted that the term "underground structure cover" is used in this specification as a generic term referring to a class including manhole covers, large iron covers and sewage pit covers for covering an opening leading from the ground surface to an underground installation, underground facilities or the like of a sewer system; openable multipurpose-duct iron covers, power-transmission covers and power-distribution covers for protecting underground power or communication facilities, apparatus, cables or the like; and hydrant covers, gate valve covers, sluice valve covers, air valve covers, gas pipe covers and water meter covers functioning as a door allowing access from on the ground to a water-supply pipe, sewage pipe or gas pipe buried under the road and additional equipment for such pipe.

BACKGROUND ART

Conventionally, as an underground structure cover, one having an inclined receiving structure is common in which the cover body is fitted in and supported by the receiving frame so that an inclined surface formed at the outer circumference of the cover body is wedged inside an inclined surface formed at the inner circumference of the receiving frame. As an underground structure cover having this inclined receiving structure, Japanese Unexamined Patent Publication No. sho 53-72357 discloses one in which the angle of inclination of the inclined surface with respect to the vertical plane, that is the vertical angle, is limited to 5° to 10°. In the underground structure cover disclosed in Japanese Unexamined Patent Publication No. sho 53-72357, by limiting the vertical angle like this, it is ensured that the cover body is wedged into the receiving frame by a sufficient force by a sufficient depth. By this, the cover body's wobbling, shaking or rattling can be suppressed to a great degree, and the cover body is almost prevented from riding up (becoming inclined instead of staying horizontal).

While the underground structure cover disclosed in Japanese Unexamined Patent Publication No. sho 53-72357 has the above-mentioned beneficial effects, the cover body thereof can be wedged into the receiving frame too deeply, in some setting environment. Thus, sometimes a large amount of labor is required to open the cover with a bar, and sometimes there is difficulty in opening the cover.

Further, in the case such that a load is applied to the cover body in a manner concentrated on a peripheral part thereof, the cover body may be fitted in and supported improperly, which may cause the cover body to become inclined or ride up.

In order to prevent the cover body from being wedged into the receiving frame too deeply, Japanese Examined Utility Model Publication No. sho 60-19162 discloses an underground structure cover in which the inclined surface of the cover body includes an intermediate gently-inclined part and the inclined surface of the receiving frame includes an intermediate gently-inclined part, so that, when the cover body is fitted in the receiving frame with their inclined surfaces meeting each other, a gap is left between the gently-inclined part of the cover body and the gently-inclined part of the receiving frame.

However, in the underground structure cover disclosed in Japanese Examined Utility Model Publication No. sho 60-19162, the gap can only delay the cover body getting wedged deeper (sinking) into the receiving frame, and cannot provide a fundamental solution for preventing the cover body from being wedged in too deeply. Further, no consideration is given to the problem that the cover body becomes inclined or rides up.

DISCLOSURE OF THE INVENTION

An object of the invention is to provide an underground structure cover that can prevent the cover body from being wedged into the receiving frame too deeply and also from becoming inclined with respect to the receiving frame or riding up.

In order to achieve the above object, the underground structure cover according to the present invention comprises a cover body and a receiving frame designed so that the cover body is fitted in and supported by the receiving frame in the manner that an inclined surface formed at an outer circumference of the cover body is received on an inclined surface formed at an inner circumference of the receiving frame, wherein the inclined surface of the outer circumference of the cover body and the inclined surface of the inner circumference of the receiving frame each include an upper inclined surface and a lower inclined surface, the lower inclined surface is steeper than the upper inclined surface in each of the cover body and the receiving frame, and the cover body is fitted in and supported by the receiving frame so that the upper inclined surface and lower inclined surface of the cover body are received on the upper inclined surface and lower inclined surface of the receiving frame, respectively.

In the underground structure cover of the inclined receiving structure, when the inclined surfaces of the cover body and the receiving frame are steeper, the force which wedges the cover body into the receiving frame is greater, so that the cover body's becoming inclined with respect to the receiving frame or riding up can be suppressed. Meanwhile, when the inclined surfaces of the cover body and the receiving frame are gentler, the force which wedges the cover body into the receiving frame is smaller, so that the cover body can be prevented from being wedged in too deeply. In the present invention, it is so arranged that the cover body is fitted in and supported by the receiving frame at its upper inclined surface and lower inclined surface which are different in inclination. By this, the force which wedges the cover body into the receiving frame can be controlled as a whole, so that the cover body can be prevented from being wedged into the receiving frame too deeply.

When the inclined surface is gentler, the horizontal component of the force is greater. This means that the force deforming the receiving frame radially outward is greater, and hence the deformation of the receiving frame is greater. Further, as a basic structure for the receiving frame, the structure in which an inclined surface is formed at the upper part of a cylindrical part, and a flange is formed at the bottom of the cylindrical part is common. In this structure, the rigidity of the cylindrical part of the receiving frame becomes higher downward, so that the deformation thereof caused by external force becomes smaller downward. In the present invention, it is arranged that the lower inclined surface is steeper than the upper inclined surface. By this, it is ensured that the cover body is wedged into the receiving frame mostly in the region of the lower inclined surface of the receiving frame which has higher rigidity and hence is less deformed by external force. Consequently, the cover body is fitted in and supported by the receiving frame properly, so that the cover body's wobbling or riding up can be suppressed.

Further, in the present invention, since the cover body is fitted in and supported by the receiving frame at two places, namely at its upper inclined surface and its lower inclined surface, the cover body can be securely fixed to the receiving frame and its shaking and wobbling can be prevented.

In the underground structure cover according to the present invention, it is desirable that, when the cover body is fitted in and supported by the receiving frame, a gap be left between the cover body and the receiving frame so that the outer circumference of the cover body and the inner circumference of the receiving frame do not touch each other in a region between their upper inclined surfaces and their lower inclined surfaces. By leaving the gap between the cover body and the receiving frame like this, the area of contact between the inclined surface of the cover body and the inclined surface of the receiving frame can be adjusted. By this, the force which wedges the cover body in can be easily controlled.

Further, the underground structure cover according to the present invention can be so arranged that the cover body is round in shape and that the gap is defined by an intermediate inclined surface between the upper and lower inclined surfaces of the cover body and an intermediate inclined surface between the lower and upper inclined surfaces of the receiving frame. In this case, the intermediate inclined surface of the receiving frame is formed as a continuously curved surface which connects the upper and lower inclined surfaces of the receiving frame and includes a receiving-frame convex part projecting to the inside of the receiving frame and a receiving-frame concave part located above the receiving-frame convex part, while the intermediate inclined surface of the cover body is formed as a continuously curved surface which connects the upper and lower inclined surfaces of the cover body and includes a cover-body concave part corresponding to the receiving-frame convex part and a cover-body convex part corresponding to the receiving-frame concave part.

In the case where the intermediate inclined surfaces are provided like this, when the cover body is pushed from behind into the receiving frame in order to close the cover, the lower part of the cover-body convex part comes in contact with the upper part of the receiving-frame convex part. Then, when the cover body is further pushed from behind, the contact area of the cover-body convex part at which the cover-body convex part is in contact with the receiving-frame convex part gradually shifts forward in the manner that the cover-body convex part is guided by the receiving-frame convex part. Thus, the cover body can be smoothly fitted into the receiving frame only by pushing in the cover body from behind.

In the present invention, it is desirable that the vertical angle of the lower inclined surfaces of the cover body and the receiving frame be in the range of 3° to 10°, and the vertical angle of the upper inclined surfaces thereof be in the range of 7° to 20°. With this desirable arrangement, the force which wedges the cover body into the receiving frame can be controlled precisely to achieve both the prevention of the cover body being wedged in too deeply and the suppression of the cover body becoming inclined with respect to the receiving frame or riding up, to a high degree.

BEST MODE OF CARRYING OUT THE INVENTION

Figure 1:
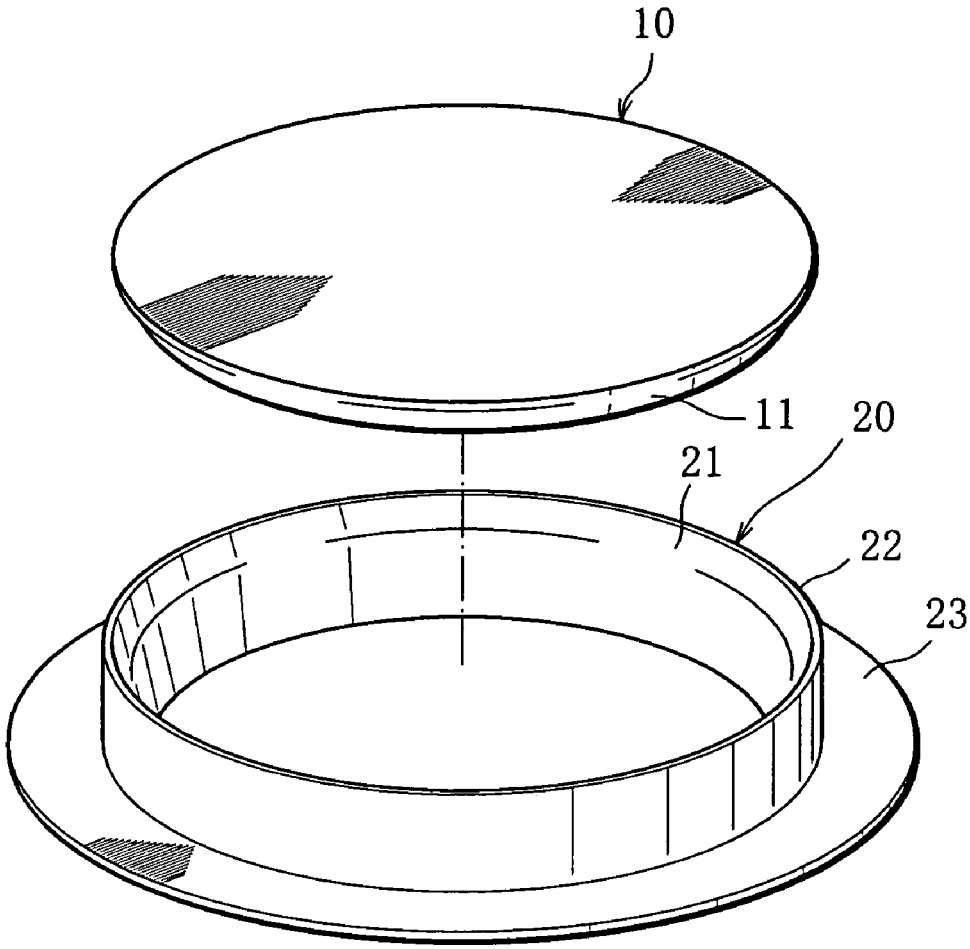
[FIG. 1] An exploded perspective view of an underground structure cover in an embodiment of this invention.

As shown in FIG. 1, an underground structure cover comprises a round cover body 10 and a receiving frame 20 for receiving and supporting the cover body 10. The cover body 10 is connected with the receiving frame 20 by a hinge (not shown) and can open and closes the receiving frame 20.

The cover body 10 has an inclined surface 11 formed at its outer circumference, while the receiving frame 20 has an inclined surface 21 formed at the upper part of the inner circumference of its cylindrical part 22 to fit with the inclined surface 11 to support the cover body 10. The receiving frame 11 has a flange 23 at the bottom of the cylindrical part 22. This underground structure cover is fitted, for example, to the upper end of an upper block of a manhole so that the upper surface of the underground structure cover is flush with the ground surface.

Figure 2:
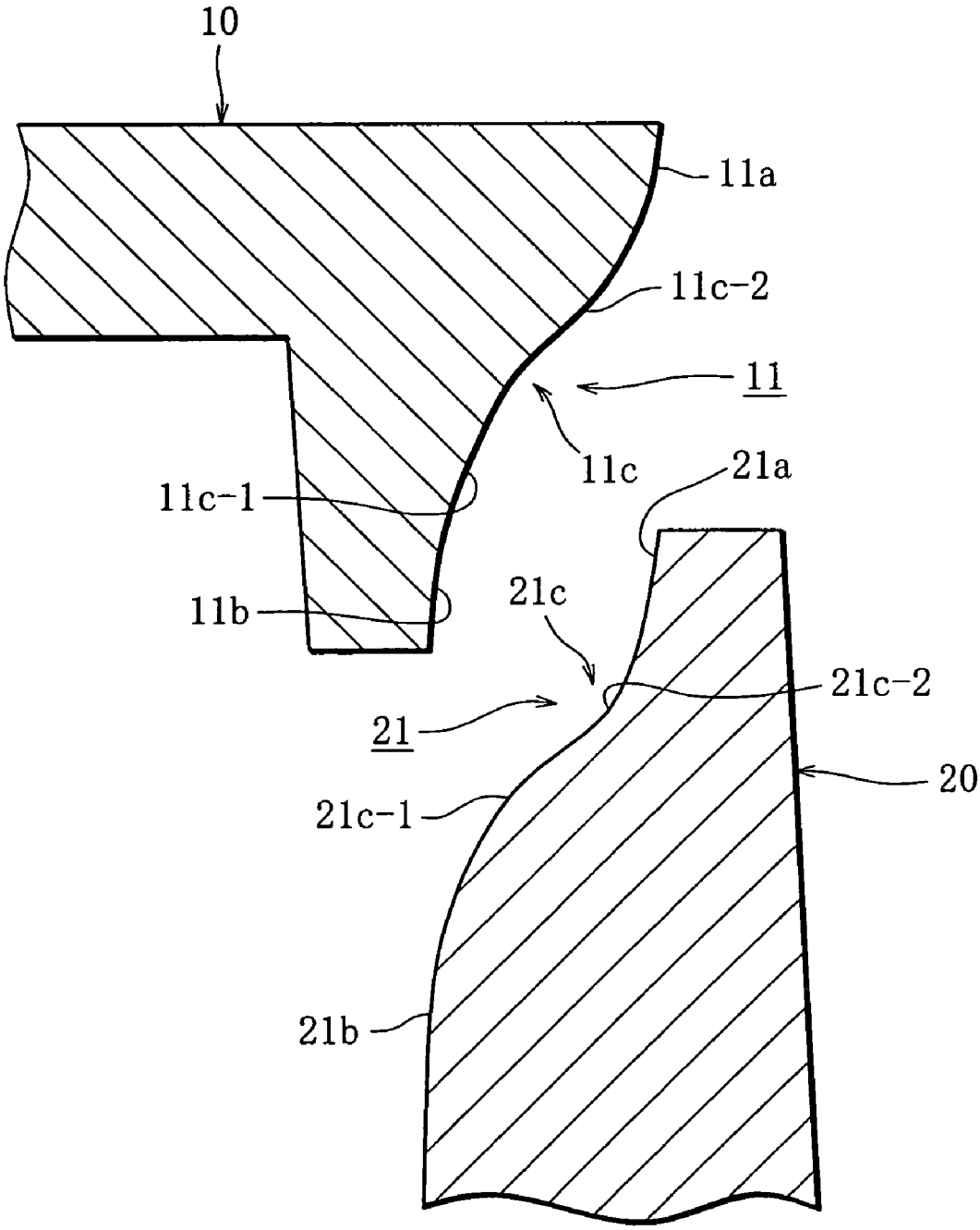
[FIG. 2] A partial vertical cross-sectional view showing relevant parts of the underground structure cover in a state that a cover body is lifted off a receiving frame.

FIG. 2 shows the underground structure cover in a state that the cover body is lifted off the receiving frame. As shown in FIG. 2, the inclined surface 21 of the receiving frame 21 comprises an upper inclined surface 21*a* which tapers downward to decrease the inner diameter of the frame 21, a lower inclined surface 21*b* which also tapers downward to decrease the inner diameter of the frame 21, and a continuously-curved intermediate inclined surface 21*c* which connects the upper inclined surface 21*a* and the lower inclined surface 21*b*.

The intermediate fitting part 21*c* includes a receiving-frame convex part 21*c*-1 which projects toward the inside of the receiving frame 20, and a receiving-frame concave part 21*c*-2 which follows the receiving-frame convex part 21*c*-1 on the upper side. The receiving-frame concave part 21*c*-2 is followed by the upper inclined surface 21*a* on the upper side, and the receiving-frame convex part 21*c*-1 is followed by the lower inclined surface 21*b* on the lower side.

Thus, the inclined surface 21 of the receiving frame body 20 forms an S-shaped curved circumferential surface as a whole, and thereby forms the inner circumferential surface of the receiving frame 20 having a shape like an inverted truncated cone.

Meanwhile, the inclined surface 11 of the cover body 10 comprises an upper inclined surface 11*a* which tapers downward to decrease the outer diameter of the cover body, a lower inclined surface 11*b* which also tapers downward to decrease the outer diameter of the cover body, and a continuously-curved intermediate inclined surface 11*c* which connects the upper inclined surface 11*a* and the lower inclined surface 11*b*.

The intermediate inclined surface 11*c* includes a cover-body concave part 11*c*-1 which corresponds to the receiving-frame convex part 21*c*-1, and a cover-body convex part 11*c*-2 which follows the cover-body concave part 11*c*-1 on the upper side and corresponds to the receiving-frame concave part 21*c*-2. The cover-body convex part 11*c*-2 is followed by the upper inclined surface 11*a* on the upper side, and the cover-body concave part 11*c*-1 is followed by the lower inclined surface 11*b* on the lower side.

Thus, the inclined surface 11 of the cover body 10 forms an S-shaped curved circumferential surface as a whole, and thereby forms the outer circumferential surface of the cover body 10 having a shape like an inverted truncated cone.

In order that the cover body 10 can be fitted in the receiving frame 20, the angles of inclination of the upper inclined surface 11*a* and of the lower inclined surface 11*b* of the cover body 10 are equal to those of the upper inclined surface 21*a* and of the lower inclined surface 21*b* of the receiving frame 20, respectively, and the outer circumferential surface of the cover body 10 and the inner circumferential surface of the receiving frame 20 have shapes complementary to each other.

It is to be noted that the lower inclined surfaces 11*b* and 21*b* are steeper than the upper inclined surfaces 11*a* and 21*a*. For example, the vertical angle of the lower inclined surfaces 11*b* and 21*b* is set in the range of 3° to 10°, for example, at 6°, while the vertical angle of the upper inclined surfaces 11*a* and 21*a* is set in the range of 7° to 20°, for example, at 10°. By arranging that the lower inclined surfaces of the cover body 10 and the receiving frame 20 are 4° (generally, 1° to 10°) steeper than their respective upper inclined surfaces like this, the force which wedges the cover body 10 into the receiving frame 20 can be controlled precisely. Thus, as described later, the prevention of the cover body 10 being wedged into the receiving frame too deeply, and the suppression of the cover body 10 becoming inclined with respect to the receiving frame 20 or riding up can be both achieved to a high degree.

Figure 3:
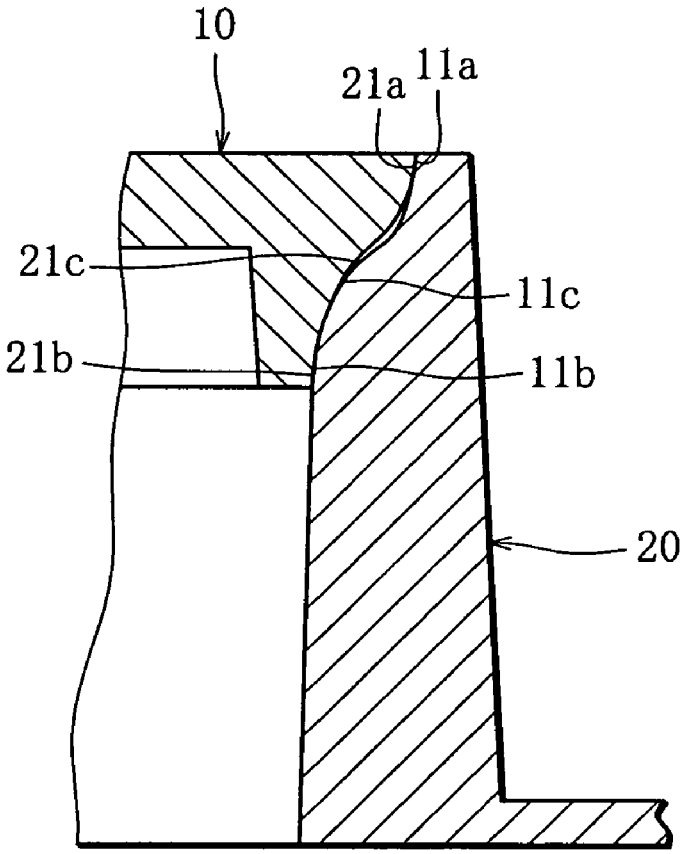
[FIG. 3] A partial vertical cross-sectional view showing the relevant parts of the underground structure cover in a state that the cover body is fitted in and supported by the receiving frame.

FIG. 3 shows the underground structure cover in a closed state where the cover body is fitted in and supported by the receiving frame. As shown in FIG. 3, in the closed state, the upper inclined surface 11*a* and lower inclined surface 11*b* of the cover body 10 meet the upper inclined surface 21*a* and lower inclined surface 21*b* of the receiving frame 20, respectively, so that the cover body is fitted in and supported by the receiving frame at two places, namely at the upper inclined surface 11*a* which meets the upper inclined surface 21*a* and at the lower inclined surface 11*b* which meets the lower inclined surface 21*b*. Meanwhile, the intermediate inclined surface 11*c* of the cover body 11 does not meet the intermediate inclined surface 21*c* of the receiving frame 21*c*, so that a gap is formed between them. The gap can be made, for example, by making the upper inclined surface 21*a* of the receiving frame 20 longer than the upper inclined surface 11*a* of the cover body 11.

Table 1 shows the result of analysis of the displacement of the cover body caused by applying a load to a peripheral part of the cover body fitted in and supported by the receiving frame, under the conditions below, where the vertical angles of the inclined surfaces were changed.

Diameter of cover body: 650 mm

Total height of inclined surface: 39.5 mm

Height of upper inclined surface: 5 mm

Height of lower inclined surface: 5 mm

Coefficient of friction between inclined surfaces: 0.16

Area of the part at which load is applied (size of load bearing plate): 200×200 mm Rate of applying load: 10 kN/sec

TABLE 1

| | Vertical angle | | Behavior of cover body (displacement) (mm) | | | | | |
|---|---|---|---|---|---|---|---|---|
| | Upper inclined surface | Lower inclined surface | When load is applied | | | After load is removed | | |
| | | | A | B | \|A − B\| | A | B | \|A − B\| |
| Example | 12° | 6° | 0.151 | −0.407 | 0.558 | 0.238 | −0.051 | 0.289 |
| Comparative example 1 | 6° | 6° | 0.171 | −0.566 | 0.737 | 0.192 | −0.186 | 0.378 |
| Comparative Example | 6° | 12° | 0.659 | −0.897 | 1.556 | 0.951 | −0.652 | 1.603 |

A: Side on which load is applied,
B: Side on which no load is applied

As shown in Table 1, in the example of the present invention in which the lower inclined surface was steeper than the upper inclined surface, the displacement of the cover body was smaller compared with comparative example 1 in which the lower inclined surface was equal in the vertical angle to the upper inclined surface and comparative example 2 in which the lower inclined surface was gentler than the upper inclined surface. Thus, it was confirmed that in the present invention, even if a load is applied to the cover body in a manner concentrated on a peripheral part thereof, the cover body's being wedged in too deeply can be prevented, and also the cover body's becoming inclined or riding up can be suppressed.

Figure 4A:
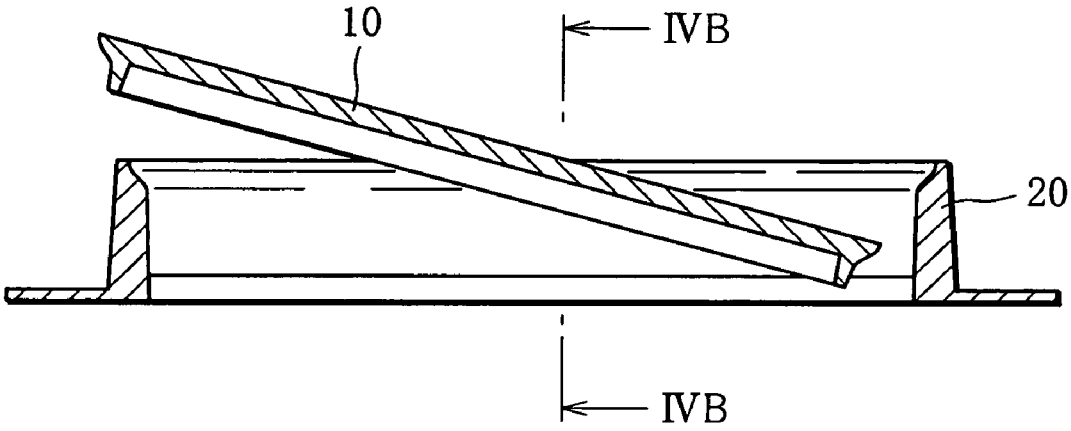
[FIG. 4A] A cross-sectional view showing the underground structure cover shown in FIG. 1 in a state that the cover body is almost laid on the receiving frame, for explaining how the underground structure cover is closed.
Figure 4B:
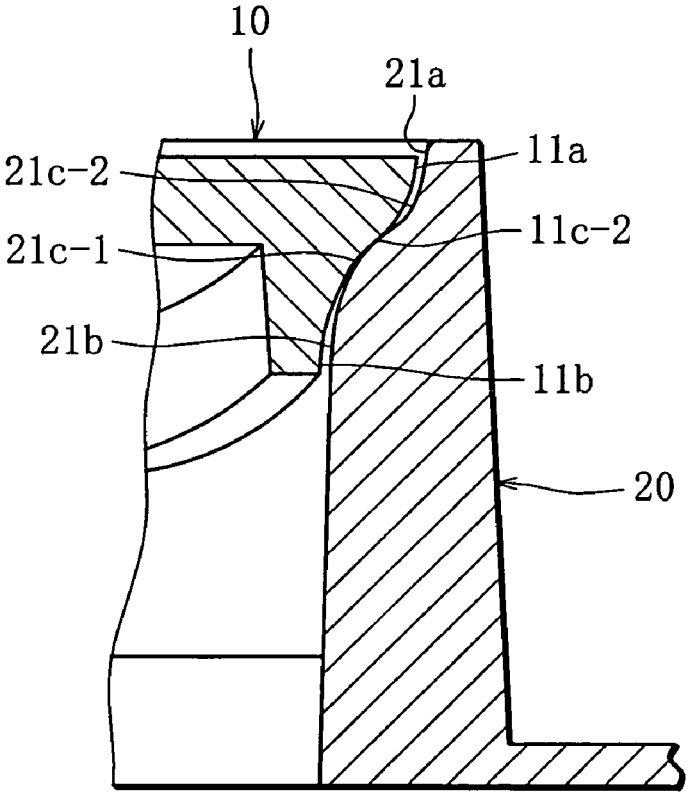
[FIG. 4B] A partial cross-sectional view along line IVB-IVB in FIG. 4A.

Next, with reference to FIG. 4, how the underground structure cover according to the present invention is closed will be explained. FIG. 4A shows a cross-sectional view of the underground structure cover in a state that, in order to close the underground structure cover that was once opened, the cover body has been turned horizontally, so that the cover body is almost laid on the receiving frame. FIG. 4B shows a cross-sectional view along line IVB-IVB in FIG. 4A at a contact area between the inclined surface of the cover body and the inclined surface of the receiving frame in this state.

As shown in FIG. 4B, when the cover body 10 is almost laid on the receiving frame 20 in order to close the underground structure cover, the lower part of the cover-body convex part 11*c*-2 comes in contact with the upper part of the receiving-frame convex part 21*c*-1, which prevents the cover body 10 from coming down into the receiving frame too deeply. In this state, when the cover body 10 is pushed in obliquely downward by pushing it at the rear part (left end in FIG. 4A) with a foot, the part of the cover-body convex part 11*c*-2 at which the cover-body convex part 11*c*-2 is in contact with the receiving-frame convex part 21*c*-1 gradually shifts forward (to the right in FIG. 4A) in the manner that the cover-body convex part 11*c*-2 is guided by the receiving-frame convex part 21*c*-1. With this, the front part (right end in FIG. 4A) of the cover body 10 gradually rises, and eventually the cover body 10 completely fits into the receiving frame 20. Like this, the underground structure cover according to the present invention is so arranged that, when it is going to be closed, the cover body 10 shifts in the manner that the cover-body convex part 11*c*-2 is guided by the receiving-frame convex part 21*c*-1. Hence, only by pushing the cover body 10 in, the cover body 10 can be smoothly fitted into the receiving frame 20.

The beneficial effects which the underground structure cover in the above embodiment has are as follows:

1. The cover body is fitted in and supported by the receiving frame at its upper inclined surface and lower inclined surface which are different in the vertical angle. By this arrangement, the force which wedges the cover body into the receiving frame can be controlled as a whole, and the cover body can be prevented from being wedged in too deeply.
2. Since the lower inclined surfaces are steeper than the upper inclined surface, the cover body is wedged into the receiving frame mostly in the region of the lower inclined surface of the receiving frame which has higher rigidity and hence is less deformed by external force. Thus, the cover body can be prevented from becoming inclined with respect to the receiving frame or riding up.
3. Since the cover body is fitted in and supported by the receiving frame at two places, namely at its upper inclined surface and lower inclined surface, the cover body can be fixed to the receiving frame securely. Hence, the cover body can be prevented from shaking and wobbling.
4. It is arranged that the gap is formed in the region between the upper inclined surfaces of the cover body and receiving frame which meet each other and the lower inclined surfaces thereof which meet each other so that the outer circumference of the cover body and the inner circumference of the receiving frame do not touch each other in this region. The area of contact between the inclined surface of cover body and the inclined surface of the receiving frame can be adjusted by this arrangement. This means that the force which wedges the cover body into the receiving frame can be controlled easily.
5. The intermediate inclined surface of the receiving frame includes the receiving-frame convex part projecting to the inside of the receiving frame, and the intermediate inclined surface of the cover body includes the cover-body convex part. Hence, when the cover is going to be closed, the cover-body convex part shifts, being guided by the receiving-frame convex part. Hence, the cover body can be smoothly fitted into the receiving frame only by dragging the cover body with a crowbar or pushing in the cover body from behind.

The invention claimed is:

1. An underground structure cover comprising a round cover body and a receiving frame designed so that said cover body is fitted in and supported by said receiving frame in a manner such that an inclined surface formed at an outer circumference of said cover body meets an inclined surface formed at an inner circumference of said receiving frame, wherein:

the inclined surface of the outer circumference of said cover body and the inclined surface of the inner circumference of said receiving frame each include an upper inclined surface and a lower inclined surface, in each of said cover body and said receiving frame, the lower inclined surface is steeper than the upper inclined surface, said cover body is fitted in and supported by said receiving frame at the upper inclined surface and lower inclined surface thereof which meet the upper inclined surface and lower inclined surface of said receiving frame, respectively, a gap is provided between said cover body and said receiving frame so that the outer circumference of said cover body and the inner circumference of said receiving frame do not touch each other in a region between the upper inclined surfaces and the lower inclined surfaces when said cover body is fitted in and supported by said receiving frame, the gap is defined by an intermediate inclined surface between the lower and upper inclined surfaces of said cover body and an intermediate inclined surface between the lower and upper inclined surfaces of said receiving frame, the intermediate inclined surface of said receiving frame is a continuously curved surface which connects the upper and lower inclined surfaces of said receiving frame and includes a receiving-frame convex part projecting inside of said receiving frame and a receiving-frame concave part located above the receiving-frame convex part, and the intermediate inclined surface of said cover body is a continuously curved surface which connects the upper and lower inclined surfaces of said cover body and includes a cover-body concave part corresponding to the receiving-frame convex part and a cover-body convex part corresponding to the receiving-frame concave part.

2. The underground structure cover according to claim 1, wherein vertical angles of the lower inclined surfaces of said cover body and said receiving frame are in a range of 3° to 10°, and vertical angles of the upper inclined surfaces thereof are in a range of 7° to 20°.

3. The underground structure cover according to claim 1, wherein said receiving frame has an outer flange formed at a bottom thereof.

4. The underground structure cover according to claim 2, wherein said receiving frame has an outer flange formed at a bottom thereof.

* * * * *